US006053480A

United States Patent [19]

De Guise

[11] Patent Number: 6,053,480

[45] Date of Patent: Apr. 25, 2000

[54] KIT FOR A GUARDRAIL OR FENCE

[76] Inventor: Yvon De Guise, 2201 De Milan, Vimont, Laval, Canada, H7K 2H1

[21] Appl. No.: 09/068,606

[22] PCT Filed: Sep. 11, 1997

[86] PCT No.: PCT/CA97/00674

§ 371 Date: May 11, 1998

§ 102(e) Date: May 11, 1998

[87] PCT Pub. No.: WO98/11311

PCT Pub. Date: Mar. 19, 1998

Related U.S. Application Data

[60] Provisional application No. 60/026,103, Sep. 13, 1996.

[51] Int. Cl.[7] ..... E04H 17/14

[52] U.S. Cl. ..... 256/59; 256/65; 256/22

[58] Field of Search ..... 256/59, 65, 66, 256/68, 19, 70, 22, 21; 403/348

[56] References Cited

U.S. PATENT DOCUMENTS

| | | | |
|---|---|---|---|
| 3,955,799 | 5/1976 | Lauzier | 256/59 X |
| 3,973,756 | 8/1976 | Lauzier | 256/65 X |
| 4,027,855 | 6/1977 | Lauzier | 256/59 X |
| 4,373,310 | 2/1983 | Dean | 256/65 X |
| 4,390,164 | 6/1983 | Cokelekoglu | 256/65 |
| 4,600,179 | 7/1986 | Willetts | 256/22 |
| 4,883,256 | 11/1989 | Hebda | 256/22 |
| 5,382,001 | 1/1995 | Lichti | 256/59 |

FOREIGN PATENT DOCUMENTS

| | | | |
|---|---|---|---|
| 21773 | of 1906 | United Kingdom | 256/65 |
| 2070664 | 9/1981 | United Kingdom | 256/59 |

*Primary Examiner*—Lynne H. Browne
*Assistant Examiner*—David E. Bochna
*Attorney, Agent, or Firm*—Swabey Ogilvy Renault

[57] ABSTRACT

A kit for a guardrail or fence having at least one railing and a plurality of balusters insertable in the railing wherein each of the balusters has at least a portion with a circular cylindrical outer surface and at least one rib on the outer surface extending parallel to the axis of the baluster. The railing includes a channel member having a first wall and a pair of parallel side walls wherein a series of circular openings are provided in the first wall to receive the circular cylindrical portions of the balusters; the rib on each baluster having at least a notch therein, the first wall defining the circular opening for receiving the circular cylindrical portion of the baluster defining a notch corresponding to at least the shape of the rib on the baluster, such that when the baluster is inserted into the opening the rib is aligned with the notch in the first wall until the notch in the rib corresponds with the plane of the first wall, allowing the baluster to be rotated on its axis and thereby being locked with respect to the railing.

5 Claims, 9 Drawing Sheets

KIT FOR A GUARDRAIL OR FENCE

This application claims benefit of Provisional application Ser. No. 60/026,103, filed Sep. 13, 1996.

TECHNICAL FIELD

The present invention relates to a fence or guardrail, and more particularly to a prefabricated kit for constructing a fence or guardrail.

BACKGROUND ART

There is considerable advantage in prefabricating the railings and balusters for a fence or guardrail, whereby these elements can be erected on site with a minimum of tools and fasteners and the like.

There have been many examples of guardrail kits designed to avoid separate fasteners. An early version of such a kit is described in my U.S. Pat. No. 4,334,671 issued Jun. 15, 1982. Other such guardrails are illustrated in U.S. Pat. No. 4,390,164 Cokelekoglu, issued Jun. 28, 1983; U.S. Pat. No. 4,451,025 Spera, issued May 29, 1984; U.S. Pat. No. 4,586,697 Tornya, issued May 6, 1986 and U.S. Pat. No. 4,805,879 Spera. All of these patents describe clip-on type kits, having a plurality of balusters to which the top and bottom railings can be snapped on.

However many of the kits referred to above have require special tools to erect the guardrails. Other available kits require several parts, making assembly complicated and generally requiring experts.

DISCLOSURE OF THE INVENTION

It is an aim of the present invention to provide a kit for erecting a fence or guardrail that is devoid of separate fasteners.

It is a further aim of the present invention to provide a guardrail kit that uses conventional tools and includes few parts.

A construction in accordance with the present invention comprises a kit for a fence or guardrail which includes at least one railing and a plurality of identical balusters to be engaged in the railing. The railing includes a bottom wall and a pair of side walls forming a channel, and at least a pair of inwardly extending flanges projecting from the side walls and parallel to the bottom wall. Each baluster has at least a portion engageable by the railing which has a circular cylindrical cross section, and at least one rib projecting on the outer surface of the circular cylindrical portion, parallel to the axis thereof. The rib is provided with a notch at a predetermined location thereon. The bottom wall of the railing is provided with a circular opening having a diameter slightly greater than the diameter of the circular cylindrical portion of the baluster, but less than the combined diameter of the circular cylindrical portion and the thickness of the rib. The bottom wall of the railing has a notch, opening into the circular opening, for receiving the rib when the baluster is aligned with the opening and the rib is aligned with the notch, such that the baluster can be inserted through the opening in the bottom wall with the rib aligned with the notch in the bottom wall and when the notch in the rib of the baluster is in the same plane as the bottom wall, the baluster can be rotated and locked with the railing.

In a more specific embodiment of the present invention the distance between the flanges extending inwardly from the side walls of the railing is the same as the diameter of the baluster and at least a notch is provided on one of the flanges adapted to receive the continuation of the rib on the circular cylindrical portion of the baluster in order to engage the rib and to prevent the baluster from being rotated about its axis when the baluster is engaged in the railing.

BRIEF DESCRIPTION OF THE DRAWINGS

Having thus generally described the nature of the invention, reference will now be made to the accompanying drawings, showing by way of illustration, preferred embodiments thereof, and in which.

MODE FOR CARRYING OUT THE INVENTION

Figure 1:
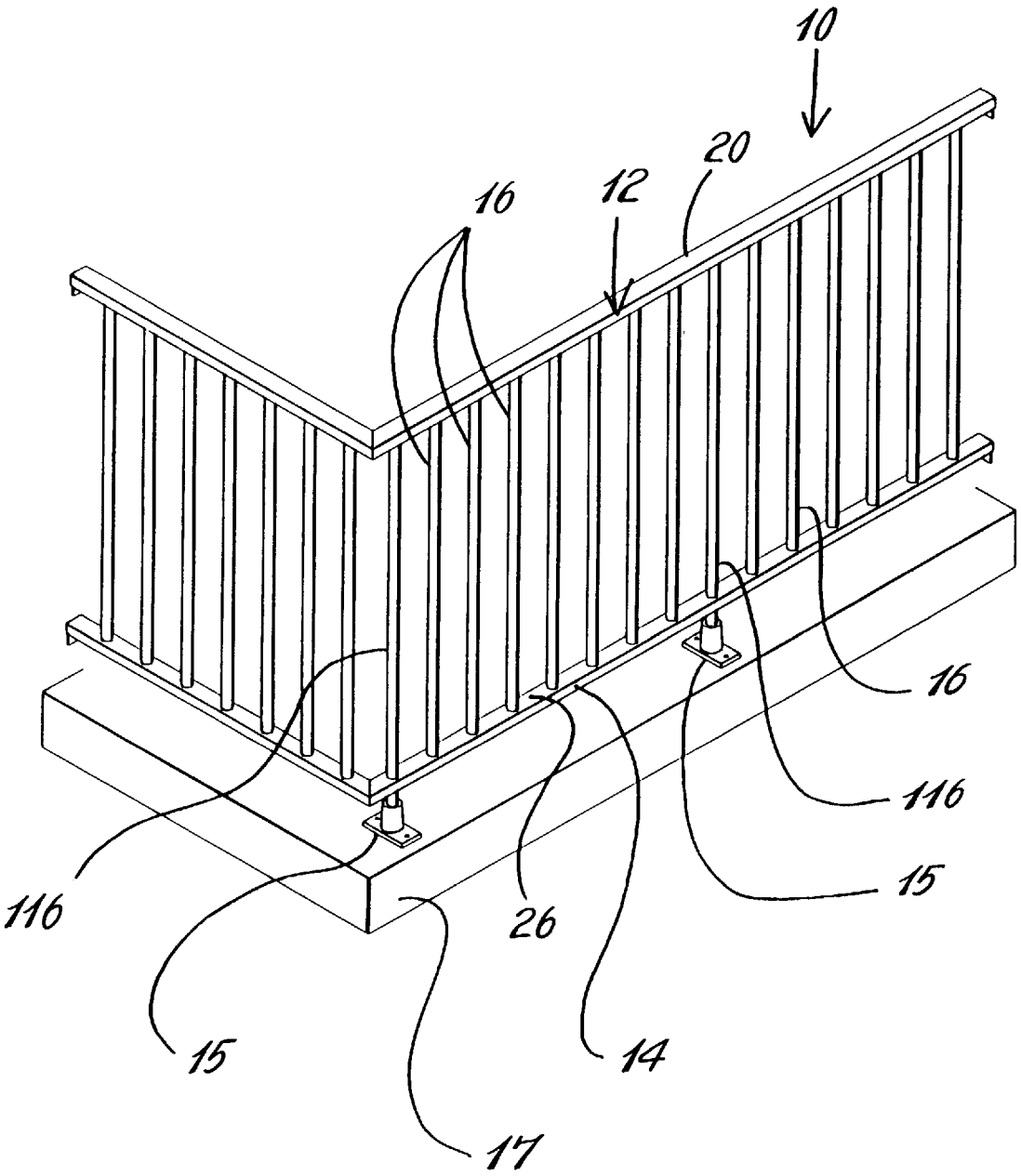
FIG. 1 is a perspective view of a guardrail in accordance with the present invention.

FIG. 1 shows a guardrail 10 having identical top railing 12 and base railing 14, and a plurality of identical balusters 16, extending between the base railing 14 and the top railing 12. A cap 20 is placed on the top of the railing 12.

Selected balusters 116 extend below the railing 14 and are received within sleeve brackets 15 which in turn can be fastened to the deck or porch platform 17.

Figure 2:
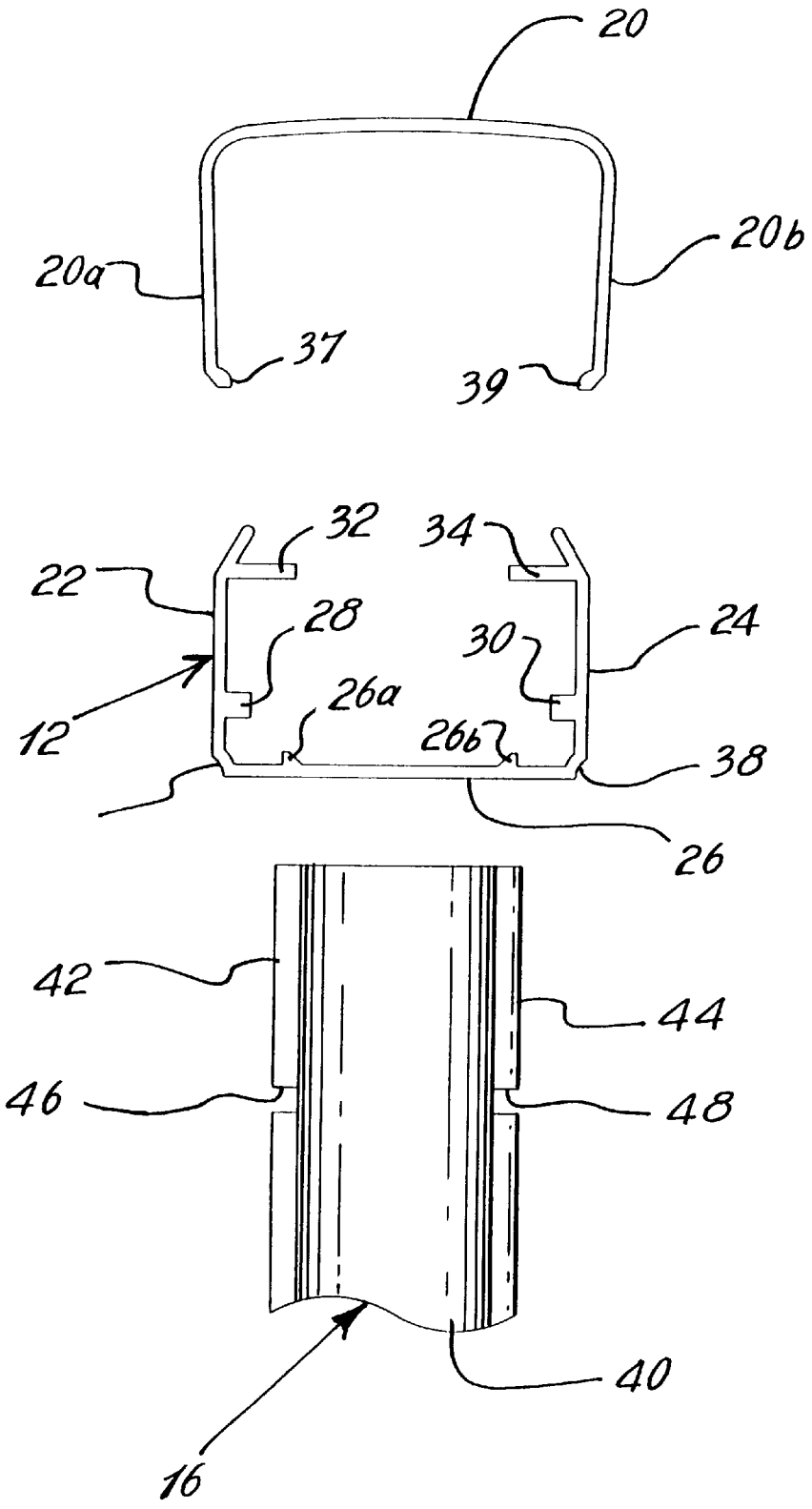
FIG. 2 is a fragmentary exploded view showing a detail of FIG. 1.
Figure 3:
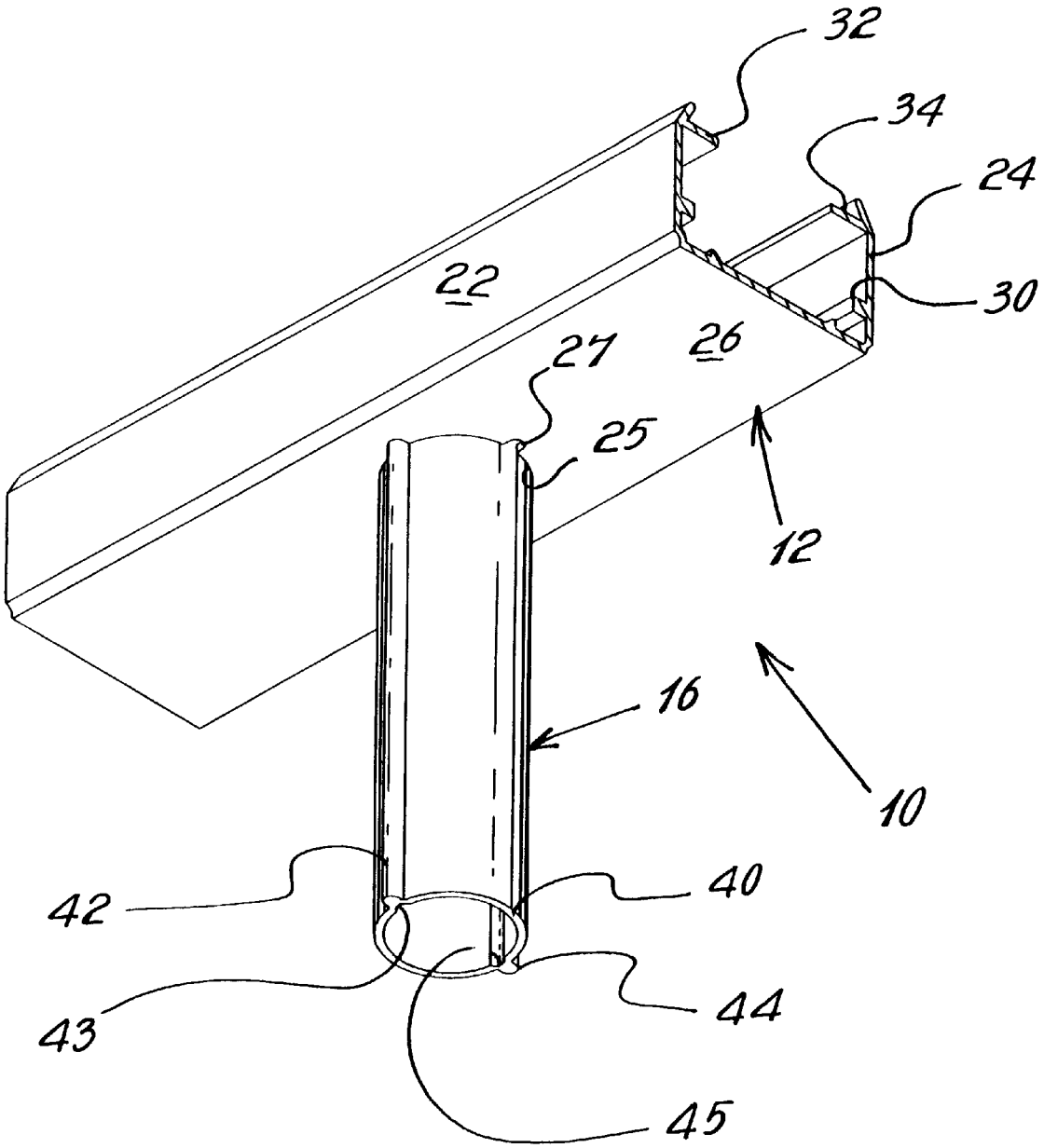
FIG. 3 is a fragmentary enlarged perspective view taken from the bottom showing certain elements of FIG. 2.
Figure 4:
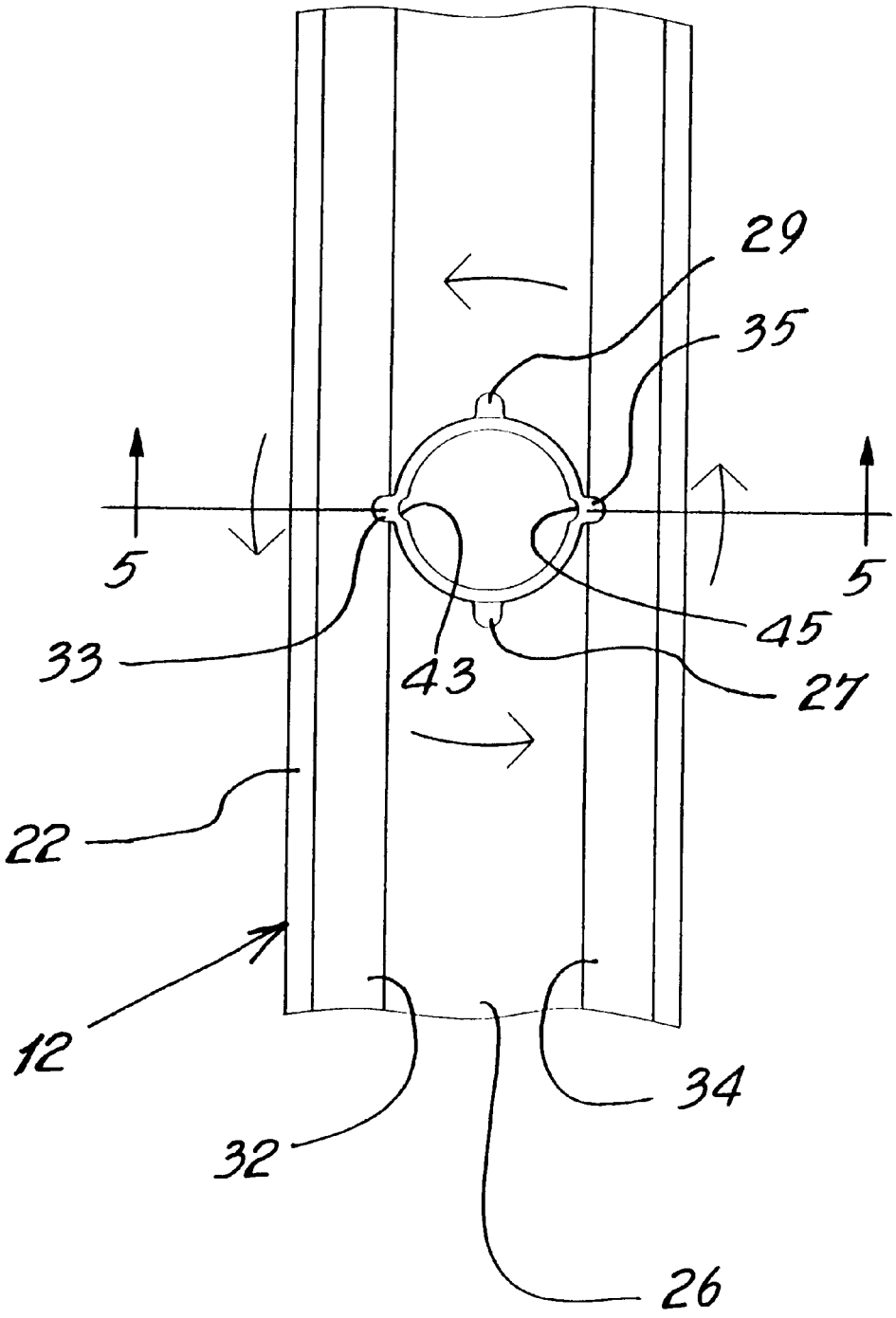
FIG. 4 is a top plan view of the embodiment shown in FIG. 3.

Referring now to FIG. 2 railing 12 is shown as including a bottom wall 26 with parallel side walls 22 and 24. The bottom wall is provided with a series of circular openings 25 adapted to receive the balusters 16 as shown in FIG. 3. A pair of opposed ribs 28 and 30 are provided on the inner surfaces of walls 22 and 24 and flanges 32 and 34 extend inwardly near the top of the walls 22 and 24. As shown in FIGS. 2 and 4, the flanges 32 and 34 are spaced apart a distance equivalent to the dimension of the outer diameter of the circular cylindrical body 40 of baluster 16. The flanges 32 and 34 are provided with opposed notches 33,35 respectively.

As shown in FIG. 2, cap 20 has a channel shape with inwardly extending ribs 37 and 39 at the lower extremities thereof of the side flanges 20*a,b*. These ribs 37 and 39 are meant to engage the slight concave indents 36 and 38 formed in the side walls 22 and 24 respectively of the railing 12. Upstanding reinforcement ribs 26*a* and 26*b* are also provided on bottom wall 26.

Each baluster 16 is provided with diametrically opposed ribs 42 and 44 which extend longitudinally of the circular cylindrical tube body 40 of the baluster 16. As shown in FIGS. 3 and 4, grooves 43 and 45 correspond with diametrically opposed ribs 42 and 44. As seen in FIGS. 2, 5, 7, 8 and 9, the ribs 42 and 44 are provided with notches 46 and 48.

Figure 7:
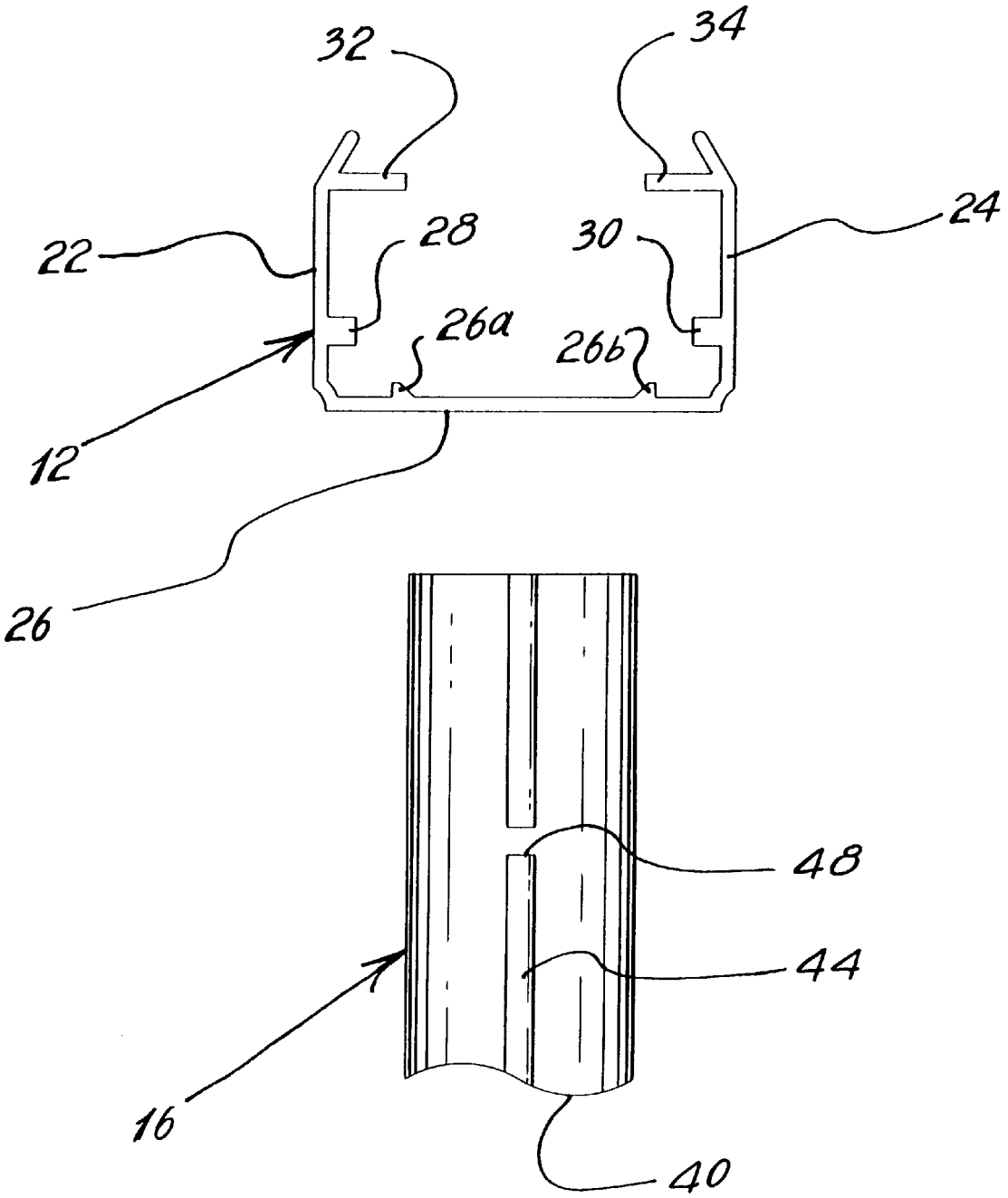
FIG. 7 is an enlarged exploded view of the embodiment shown in FIG. 2 but with the elements aligned and ready to be engaged.

The bottom wall 26 is provided with notches 27 and 29 diametrically opposed on the periphery of opening 25 and located in the longitudinal axis of the railing 12. When a kit of balusters 16 and railings 12,14 is delivered for assembly, each baluster 16 is inserted into an opening 25 of the respective railings 12,14 with the ribs 42 and 44 aligned with the notches 27 and 29 in the bottom wall 26 as shown in FIG. 7. The baluster 16 is inserted until the notches 47 and 48 of ribs 42 and 44 are coincident with the plane of the bottom wall 26, so that the baluster can be rotated in order to fix the baluster 16 in the railing 12 and 14. The baluster 16 would also be provided with notches (not shown) corresponding to the plane of the wall 26.

The railing 14 can be identical to railing 12 but would normally be inverted so that the bottom wall 26 becomes the top wall. The assembly of the kit would include passing a baluster 16 through both a railing 12 and a railing 14. The baluster 16 would be rotated to snap into the notches 33 and 35 of flanges 32 and 34 of both railings 12 and 14, simultaneously.

Figure 5:
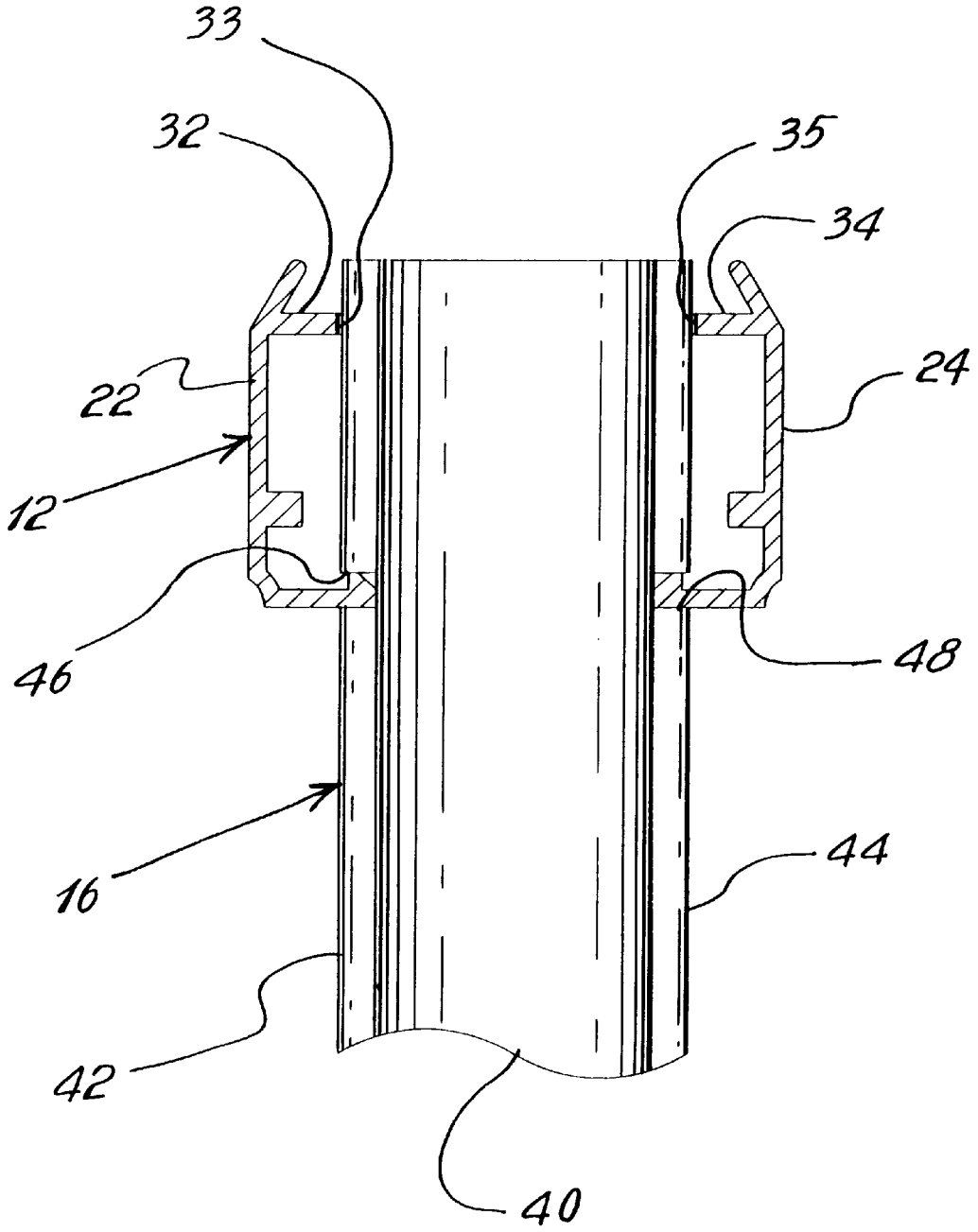
FIG. 5 is a fragmentary cross section taken along lines 5—5 of FIG. 4.
Figure 8:
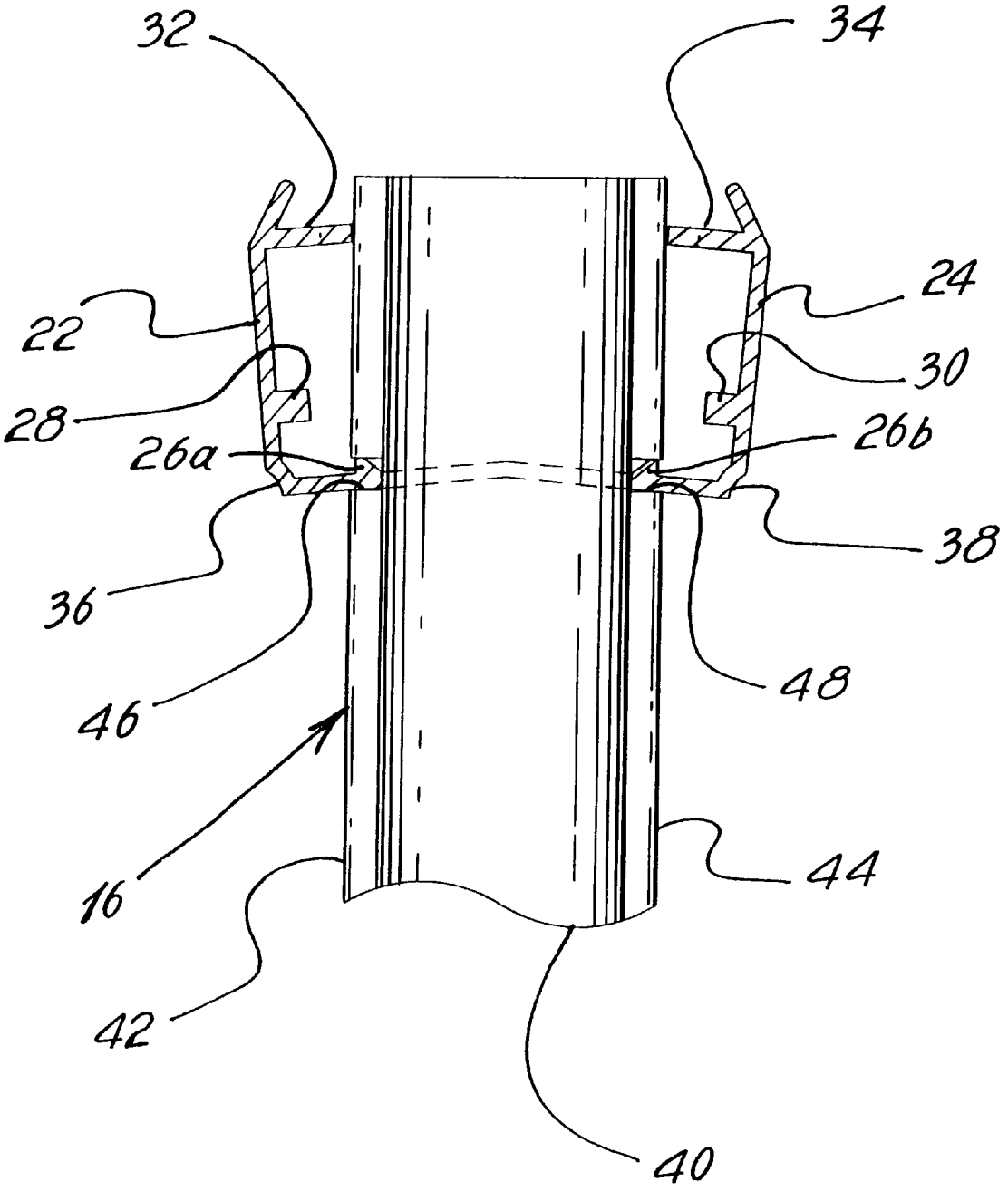
FIG. 8 is a vertical cross section showing the elements of FIG. 7 in a position being assembled.

By rotating the baluster 16 an angle of 90°, the ribs 42 and 44 engage the flanges 32 and 34 and spread them apart as shown in FIG. 8 until the ribs 42,44 come into engagement with notches 33 and 35 on the flanges 32 and 34. The ribs 42 and 44 snap into the notches 33, 35, allowing the baluster 16 to be locked therein in view of the resilience of the railing to return to its rest position, as shown in FIG. 5 for instance.

Figure 6:
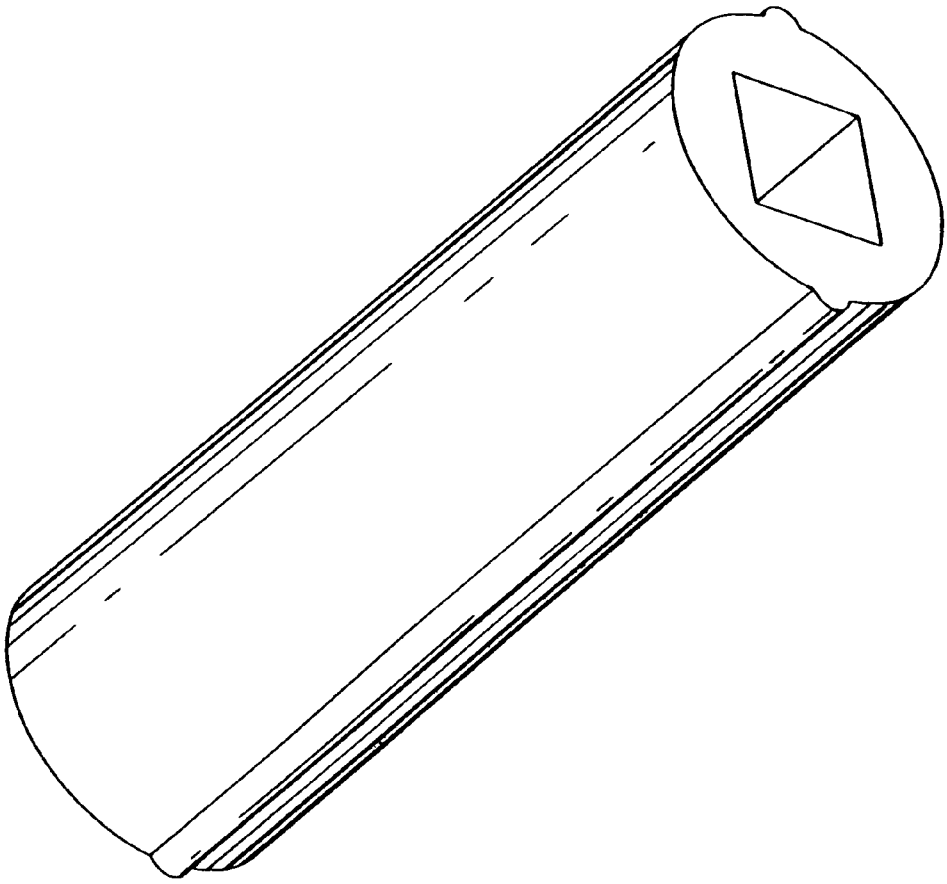
FIG. 6 is a perspective view of an element of the present invention.

A tool adapter 50 is proposed in FIG. 6. The tool 50 is an adapter for use with a ratchet set (not shown). The ratchet socket 52 is located at one end thereof, and the cylindrical adapter 50 includes ribs 54 and 56 adapted to engage the grooves 43 and 45 of the tube body 40. Thus, when the baluster 16 is inserted through the opening 25 with ribs 42 and 44 aligned with notches 27,29 in bottom wall 26, the adapter 50 is inserted into tube 40 and rotated by way of the ratchet wrench, to rotate the baluster 16 90° against the flanges 32 and 34 until the ribs 42 and 44 on the cylindrical tube 40 are engaged in notches 33 and 35, in flanges 32 and 34 respectively.

The cap 20 shown in FIG. 2 is then snapped onto the railing 12.

Figure 9:
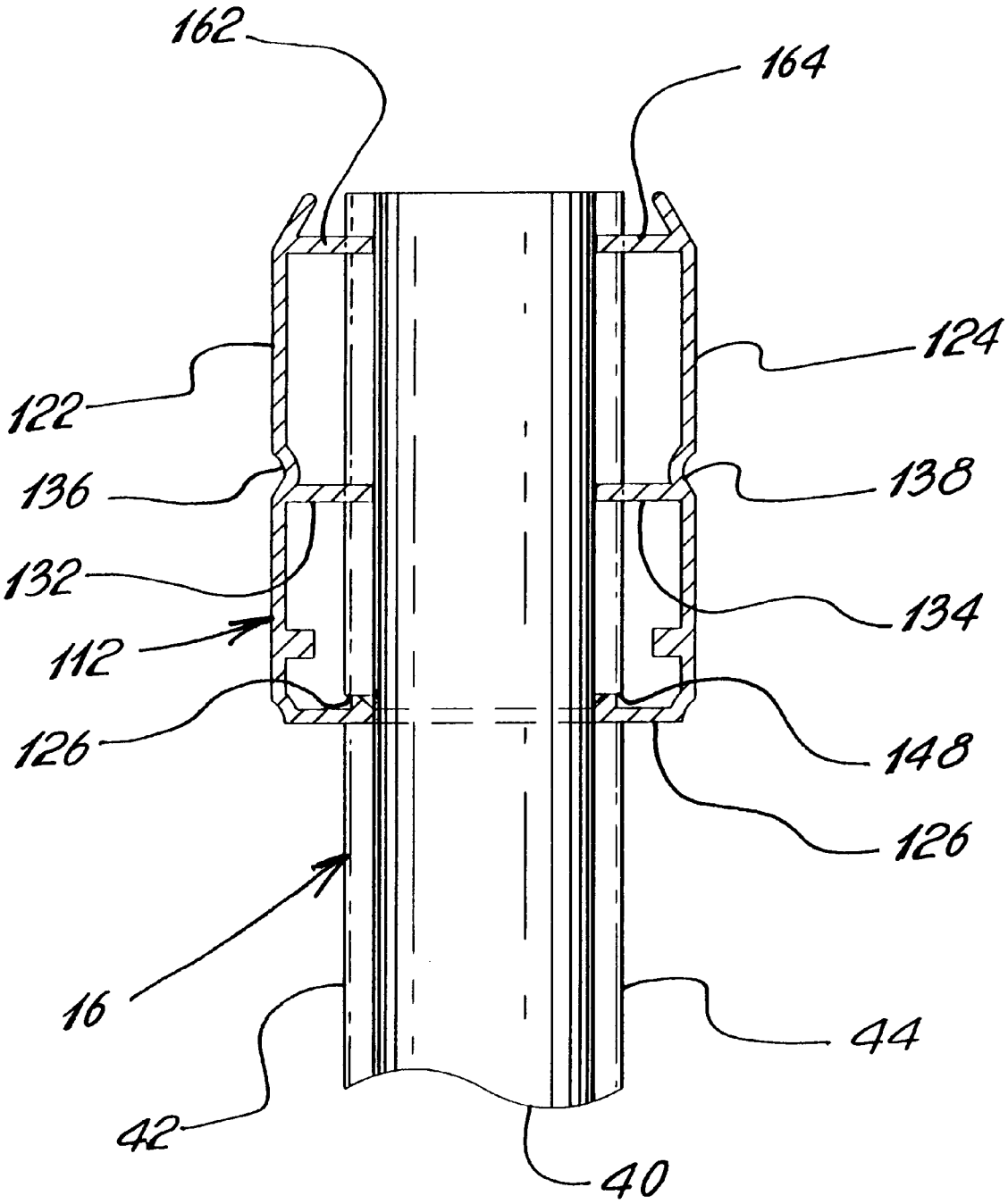
FIG. 9 is a vertical cross section showing another embodiment of the rail assembled on the baluster in accordance with the present invention.

FIG. 9 shows a different embodiment of a top railing. The numbers identifying the various elements of the embodiment in FIG. 9 have been raised by 100. In the railing 112 of FIG. 9 two pairs of flanges 132,134 and 162,164 have been provided on extended side walls 122 and 124. A cap 20 would engage the extended railing 112 in the same manner as the cap 20 with railing 12.

I claim:

1. A kit for a guardrail or fence having at least one railing and a plurality of balusters insertable in the railing wherein each of the balusters has at least a circular cylindrical portion and at least one rib on the circular cylindrical portion extending parallel to the axis of the baluster; the railing forming a channel having a first planar wall, a series of circular openings provided in the first wall to receive the at least one cylindrical portion of each baluster, the diameter of each circular opening corresponding to the diameter of the circular cylindrical portion; the channel having a pair of second walls extending from the first planar wall and the second walls each have an inwardly extending flange, at least one of the flanges having a first notch defined therein to receive the rib of the baluster when the baluster is rotated on its axis; the rib on each baluster having at least a second notch therein, the first wall defining a third notch on the circumference of the opening corresponding to the shape of the rib on the baluster, such that when the baluster is inserted into the opening, the rib of the baluster is aligned with the third notch in the first planar wall until the second notch in the rib corresponds with the plane of the first planar wall, such that the baluster can be rotated on its axis to be fixed to the railing.

2. The kit as defined in claim 1 wherein the flanges define a distance between them that is equal to the diameter of the cylindrical portion of the baluster, the baluster includes a pair of diametrically opposed ribs parallel to the axis of the baluster, the pair of ribs including the at least one rib and the other rib of the pair of ribs including a fourth notch diametrically aligned with the second notch in the at least one rib, and each flange including a first notch for receiving a respective rib of said pair of ribs when the baluster is rotated on its axis, whereby the ribs are snapped into the corresponding first notches on the respective flanges.

3. The kit as defined in claim 1 wherein the guardrail or fence includes a second railing to be assembled with the balusters parallel to and spaced apart from the at least one railing.

4. The kit as defined in claim 1 wherein a railing cap is provided whereby the cap is channel shaped including a web and a pair of flanges extending from the web and adapted to overlie the second walls of the railing and the cap and railing have snap-on mating means whereby the cap is adapted to snap onto the railing.

5. The kit as defined in claim 4 wherein the snap-on mating means includes beads on the flanges of the cap adapted to resiliently engage corresponding grooves on the second walls of the railing.

* * * * *